US011756484B2

(12) United States Patent
Yang

(10) Patent No.: US 11,756,484 B2
(45) Date of Patent: Sep. 12, 2023

(54) LIGHT-EMITTING PANEL, DRIVING METHOD OF LIGHT-EMITTING PANEL, AND DISPLAY DEVICE

(71) Applicant: Xiamen Tianma Microelectronics Co., Ltd., Xiamen (CN)

(72) Inventor: Wenbin Yang, Xiamen (CN)

(73) Assignee: Xiamen Tianma Microelectronics Co., Ltd., Xiamen (CN)

( * ) Notice: Subject to any disclaimer, the term of this patent is extended or adjusted under 35 U.S.C. 154(b) by 0 days.

(21) Appl. No.: 18/070,914

(22) Filed: Nov. 29, 2022

(65) Prior Publication Data

US 2023/0122051 A1 Apr. 20, 2023

(30) Foreign Application Priority Data

Aug. 22, 2022 (CN) ..... 202211008776.9

(51) Int. Cl.

| | |
|---|---|
| ***G09G 3/3233*** | (2016.01) |
| ***G09G 3/34*** | (2006.01) |
| *G09G 3/36* | (2006.01) |
| *G09G 3/20* | (2006.01) |

(52) U.S. Cl.

CPC ..... *G09G 3/3233* (2013.01); *G09G 3/3426* (2013.01); *G09G 3/2007* (2013.01); *G09G 3/36* (2013.01); *G09G 2300/0408* (2013.01); *G09G 2300/0426* (2013.01); *G09G 2310/0202* (2013.01); *G09G 2310/0281* (2013.01); *G09G 2310/0286* (2013.01); *G09G 2310/0291* (2013.01); *G09G 2310/0297* (2013.01); *G09G 2320/0233* (2013.01); *G09G 2330/021* (2013.01)

(58) Field of Classification Search

CPC ..... G09G 3/3233; G09G 3/2007; G09G 2320/0233; G09G 2310/0281; G09G 2300/0408; G09G 3/36; G09G 2310/0297; G09G 2310/0291; G09G 2300/0426

See application file for complete search history.

(56) References Cited

U.S. PATENT DOCUMENTS

| | | | | |
|---|---|---|---|---|
| 2019/0235336 | A1* | 8/2019 | Uehata | G02F 1/1368 |
| 2020/0134277 | A1* | 4/2020 | Lin | G06V 40/1306 |
| 2022/0335905 | A1* | 10/2022 | Miyata | G09G 3/006 |

FOREIGN PATENT DOCUMENTS

| | | |
|---|---|---|
| CN | 100353400 C | 12/2007 |
| CN | 212135912 U | 12/2020 |

* cited by examiner

*Primary Examiner* — Dennis P Joseph
(74) *Attorney, Agent, or Firm* — KDW Firm PLLC

(57) ABSTRACT

Provided are a light-emitting panel, a driving method of a light-emitting panel, and a display device. The display panel includes multiple light-emitting units, multiple first switch units, and a constant-current circuit. The light-emitting units are disposed on one side of a substrate and are arranged in an array along a first direction and a second direction. A first terminal of a light-emitting unit is electrically connected to a first supply voltage terminal. A second terminal of the light-emitting panel is electrically connected to a respective first terminal of a first switch unit. The control terminal of the first switch unit is electrically connected to a scan signal line extending along the first direction. A second terminal of the first switch unit is electrically connected to a data signal line extending along the second direction. An output terminal of the constant-current circuit is electrically connected to the data signal line.

20 Claims, 11 Drawing Sheets

LIGHT-EMITTING PANEL, DRIVING METHOD OF LIGHT-EMITTING PANEL, AND DISPLAY DEVICE

CROSS-REFERENCE TO RELATED APPLICATION

This application claims priority to Chinese patent application No. 202211008776.9 filed on Aug. 22, 2022, the disclosure of which is incorporated herein by reference in its entirety.

TECHNICAL FIELD

Embodiments of the present disclosure relate to the field of display technology and, in particular, to a light-emitting panel, a driving method of a light-emitting panel, and a display device.

BACKGROUND

With the continuous improvement of the display technology, display requirements for display panels are increasing. In existing display panel, a drive transistor used to drive a light-emitting element to emit light typically works at a saturation area so that the drive transistor can provide a stable current to ensure stable light emission of the light-emitting element. However, the drive transistor working at a saturation area causes an increase in power consumption of the display panel. Therefore, a decrease in power consumption of the display panel becomes an urgent problem to be solved.

SUMMARY

The present disclosure provides a light-emitting panel, a driving method of a light-emitting panel, and a display device to reduce the overall power consumption of the light-emitting panel and the thickness of the light-emitting panel to facilitate narrowing the border of the light-emitting panel.

An embodiment of the present disclosure provides a light-emitting panel. The light-emitting panel includes a substrate, a plurality of light-emitting units, a plurality of first switch units, and a constant-current circuit.

The plurality of light-emitting units are disposed on one side of the substrate and are arranged in an array along a first direction and a second direction. The first direction and the second direction intersect each other and are parallel to the plane where the substrate is located.

A first terminal of a light-emitting unit of the plurality of light-emitting units is electrically connected to a first supply voltage terminal, and a second terminal of the light-emitting unit is electrically connected to a first terminal of a respective first switch unit of the plurality first switch units. The control terminal of the first switch unit is electrically connected to a scan signal line extending along the first direction. The second terminal of the first switch unit is electrically connected to a data signal line extending along the second direction.

The output terminal of the constant-current circuit is electrically connected to the data signal line.

An embodiment of the present disclosure further provides a driving method of a light-emitting panel. The method is applied to the light-emitting panel described in the above-mentioned embodiment. The driving method includes acquiring a to-be-displayed grayscale value of a light-emitting unit; determining the drive current required by the light-emitting unit according to the grayscale value; controlling a constant-current circuit to supply a current to a corresponding data signal line according to the magnitude of the drive current; controlling a first switch unit to turn on so that the light-emitting unit emits light.

An embodiment of the present disclosure further provides a display device including the light-emitting panel described in the above-mentioned embodiment.

According to embodiments of the present disclosure, by electrical connection between the constant-current circuit and data signal lines, constant currents are output to the data signal lines. When a scan signal provided by a scan signal line controls first switch units to turn on, the output currents are transmitted to the light-emitting units. At the same time, under the action of the first supply voltage terminal, all light-emitting units electrically connected to the scan signal line perform light-emitting display. Depending on different luminances of the light-emitting panel, the currents required by the light-emitting units are different. It is feasible to adjust the magnitudes of the constant currents output by the output terminals of the constant-current circuit to adjust the luminances of the light-emitting units to satisfy the requirements for different luminances of the light-emitting panel or to satisfy the requirements for adjusting the luminances by zone, thereby improving the display quality of the light-emitting panel. Moreover, there is no need to provide an additional light-emitting drive circuit (for example, 7T1C pixel drive circuit). In this manner, the overall power consumption of the light-emitting panel is saved, the circuit layout is simplified, and the cost is reduced, thereby facilitating thinning and narrowing the border of the light-emitting panel.

It is to be understood that the content described in this part is not intended to identify key or important features of embodiments of the present disclosure and is not intended to limit the scope of the present disclosure. Other features of the present disclosure are apparent from the description hereinafter.

BRIEF DESCRIPTION OF DRAWINGS

To illustrate embodiments of the present disclosure more clearly, drawings used in description of the embodiments are briefly described below. Apparently, the drawings described below merely illustrate part of embodiments of the present disclosure, and those skilled in the art may obtain other drawings based on the drawings on the premise that no creative work is done.

DETAILED DESCRIPTION

For a better understanding of the present disclosure by those skilled in the art, embodiments of the present disclosure are described clearly and completely in conjunction with the drawings in embodiments of the present disclosure. Apparently, the embodiments described below are part, not all, of embodiments of the present disclosure. Based on the embodiments described herein, all other embodiments obtained by those skilled in the art on the premise that no creative work is done are within the scope of the present disclosure.

It is to be noted that the terms "first", "second" and the like in the description, claims and drawings of the present disclosure are used to distinguish between similar objects and are not necessarily used to describe a particular order or sequence. It should be understood that the data used in this manner are interchangeable where appropriate so that embodiments of the present disclosure described herein may also be implemented in a sequence not illustrated or described herein. In addition, the terms "include", "have" or any other variations thereof are intended to encompass a non-exclusive inclusion. For example, a process, method, system, product or equipment that includes a series of steps or units not only includes the expressly listed steps or units but may also include other steps or units that are not expressly listed or are inherent to such process, method, product or equipment.

Figure 1:
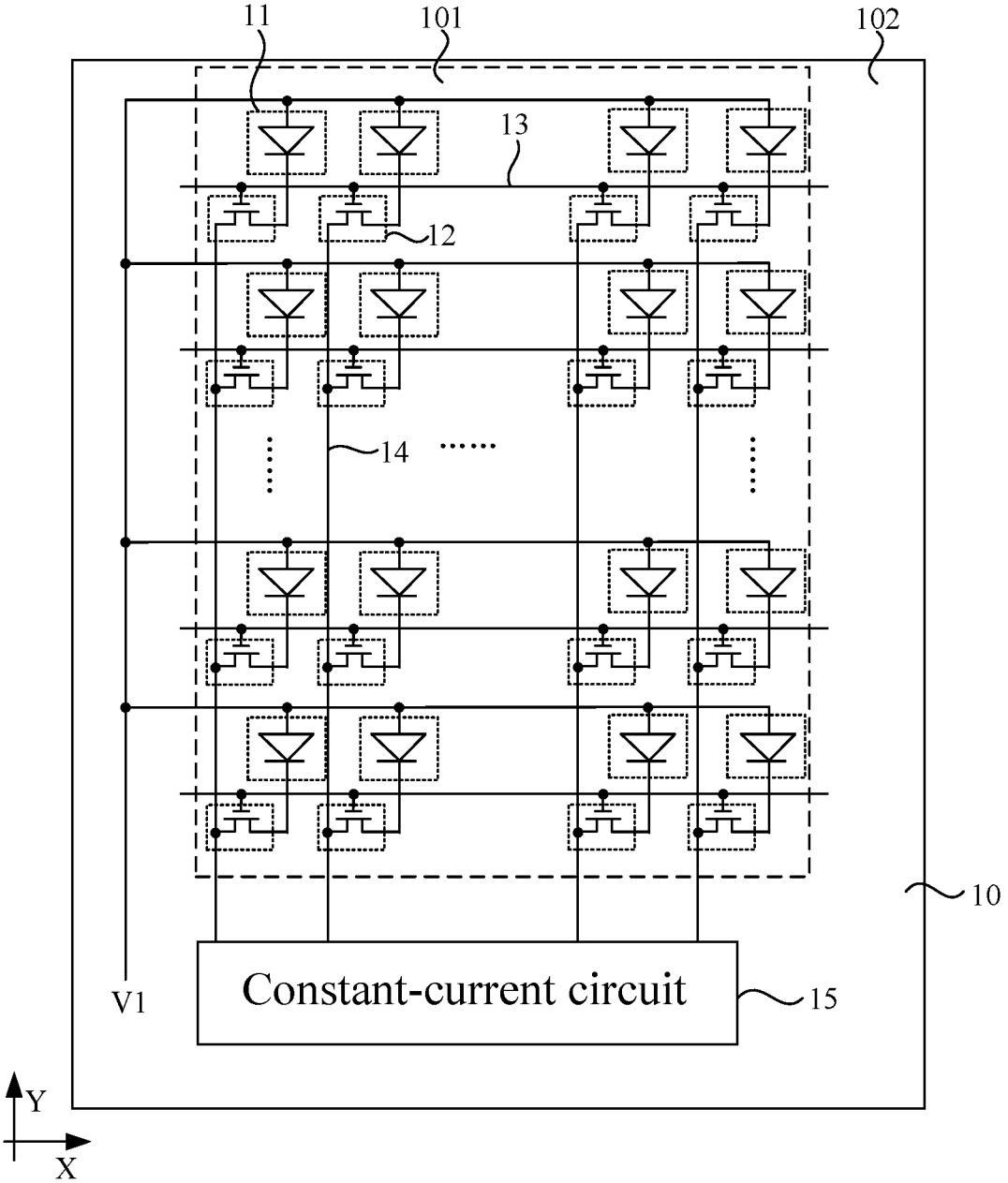
FIG. 1 is a diagram illustrating the structure of a light-emitting panel according to an embodiment of the present disclosure.

FIG. 1 is a diagram illustrating the structure of a light-emitting panel according to an embodiment of the present disclosure. As shown in FIG. 1, the light-emitting panel includes a substrate 10, multiple light-emitting units 11, multiple first switch units 12, and a constant-current circuit 15. The light-emitting units 11 are disposed on one side of the substrate 10 and are arranged in an array along a first direction X and a second direction Y. The first direction X and the second direction Y intersect each other and are parallel to the plane where the substrate 10 is located. A first terminal of a light-emitting unit 11 is electrically connected to a first supply voltage terminal V1. A second terminal of the light-emitting unit 11 is electrically connected to a first terminal of a respective first switch unit 12. The control terminal of the first switch unit 12 is electrically connected to a scan signal line 13 extending along the first direction X. A second terminal of the first switch unit 12 is electrically connected to a data signal line 14 extending along the second direction Y. An output terminal of the constant-current circuit 15 is electrically connected to the data signal line 14.

Here, the ellipses in FIG. 1 indicate a larger number of structures such as circuit devices, signal lines, and the like, and the ellipses in FIGS. 2-10 below indicate the same as in FIG. 1. The substrate 10 may be transparent, translucent, or opaque. The substrate 10 may be a flexible substrate, the material thereof may include at least one of polyimide, polyethylene terephthalate, polyethylene naphthalate, polycarbonate, polyarylate, and polyethersulfone, or the substrate 10 may also be a rigid substrate, specifically a glass substrate or other rigid substrate. The embodiment of the present disclosure do not limit species or materials of the substrate 10.

The light-emitting unit 11 may be formed of a light-emitting element (for example, a light-emitting diode) or multiple light-emitting elements, which is not limited in the embodiment of the present disclosure. The light-emitting element includes, but is not limited to, a submillimeter light-emitting diode or a micro light-emitting diode. The light-emitting panel according to the embodiment of the present disclosure may be a display panel directly performing image display, or may be a backlight panel providing light for other display panel, which is not limited in the embodiment of the present disclosure. For ease of description, the embodiment of the present disclosure is described in terms of an example in which a light-emitting panel is a display panel directly performing image display.

The first switch unit 12 may be a switch transistor, and specifically may be a P-type or an N-type, which is not limited in the embodiment of the present disclosure. If the first switch unit 12 is a P-type switch transistor, when a scan signal provided by a scan signal line is at a low level, the first switch unit 12 is controlled to be turned on; if the scan signal is at a high level, the first switch unit 12 is controlled to be turned off. Alternatively, if the first switch unit 12 is an N-type switch transistor, when the scan signal provided by the scan signal line is at the high level, the first switch unit 12 is controlled to be turned on; if the scan signal is at the low level, the first switch unit 12 is controlled to be turned off.

In an exemplary embodiment, when the scan signal provided by a scan signal line 13 in a certain row is a valid scan signal, all the first switch units 12 electrically connected to the scan signal line 13 are controlled to turned on, and at this time, the current output by the constant-current circuit 15 is transmitted to the first switch units 12 through respective data lines 14 and then to the light-emitting units 11. At the same time, under the action of the first supply voltage terminal V1, all the light-emitting units 11 electrically connected to the scan signal line 13 in the row perform light-emitting display. In this manner, the constant-current circuit 15 directly supplies stable currents to the light-emitting units 11, and no additional light-emitting drive circuit (for example, 7T1C pixel drive circuit) is required. Thus, the power consumption of the light-emitting panel can be reduced, and the heat dissipation difficulty caused by the large power consumption of the light-emitting panel can be avoided, thereby improving the quality of the light-emitting panel. Moreover, narrowing the border of the light-emitting panel is facilitated, the screen-to-body ratio is improved, and the cost of the light-emitting panel can be reduced.

It is to be understood that the luminance of the light-emitting unit 11 may be different depending on the value of the output current of the constant-current circuit 15. The value of the specific output current of the constant-current circuit 15 is not limited by the embodiment. The output current of the constant-current circuit 15 may be a fixed current or an arbitrarily adjustable current. Those skilled in the art may make selections according to actual requirements. In an exemplary embodiment, the multiple light-emitting units 11 arranged in an array in the light-emitting panel may be divided in multiple zones, and the data lines corresponding to each zone may receive a different current value of the constant-current circuit 15 so that the luminance of the light-emitting panel can be adjusted by zones.

It is to be noted that the multiple light-emitting units 11 arranged in the same column along the second direction Y may be electrically connected to the same data signal line 14, or may be electrically connected to different data signal lines 14, which is not limited in the embodiment of the present disclosure. It is to be understood that when multiple light-emitting units 11 in the same column are electrically connected to different data signal lines 14, to satisfy the luminance requirements of the light-emitting units 11 in different places of the light-emitting panel, the constant-current circuit 15 may output corresponding different currents to improve the display quality. FIG. 1 is only an exemplary diagram illustrating the structure of multiple light-emitting units 11 arranged in the same column along the second direction Y electrically connected to the same data signal line 14.

In the embodiment of the present disclosure, by electrical connection between the constant-current circuit and the data signal lines, the constant current is output to the data signal line. When the scan signal provided by the scan signal line controls the first switch unit to turn on, the output current is transmitted to the light-emitting unit. At the same time, under the action of the first supply voltage terminal, all light-emitting units electrically connected to the scan signal line in the same row perform light-emitting display. According to different luminances of the light-emitting panel, the current required by the light-emitting unit is different. The luminance can be adjusted by adjusting the value of the constant current output by the output terminal of the constant-current circuit to satisfy the requirements for different luminances of the light-emitting panel or to satisfy the requirements for adjusting luminance by zone, thereby improving the display quality of the light-emitting panel. Moreover, there is no need to provide an additional light-emitting drive circuit (for example, 7T1C pixel drive circuit). In this manner, the overall power consumption of the light-emitting panel is saved, the circuit layout is simplified, and the cost is reduced, thereby facilitating thinning and narrowing the border of the light-emitting panel.

Figure 2:
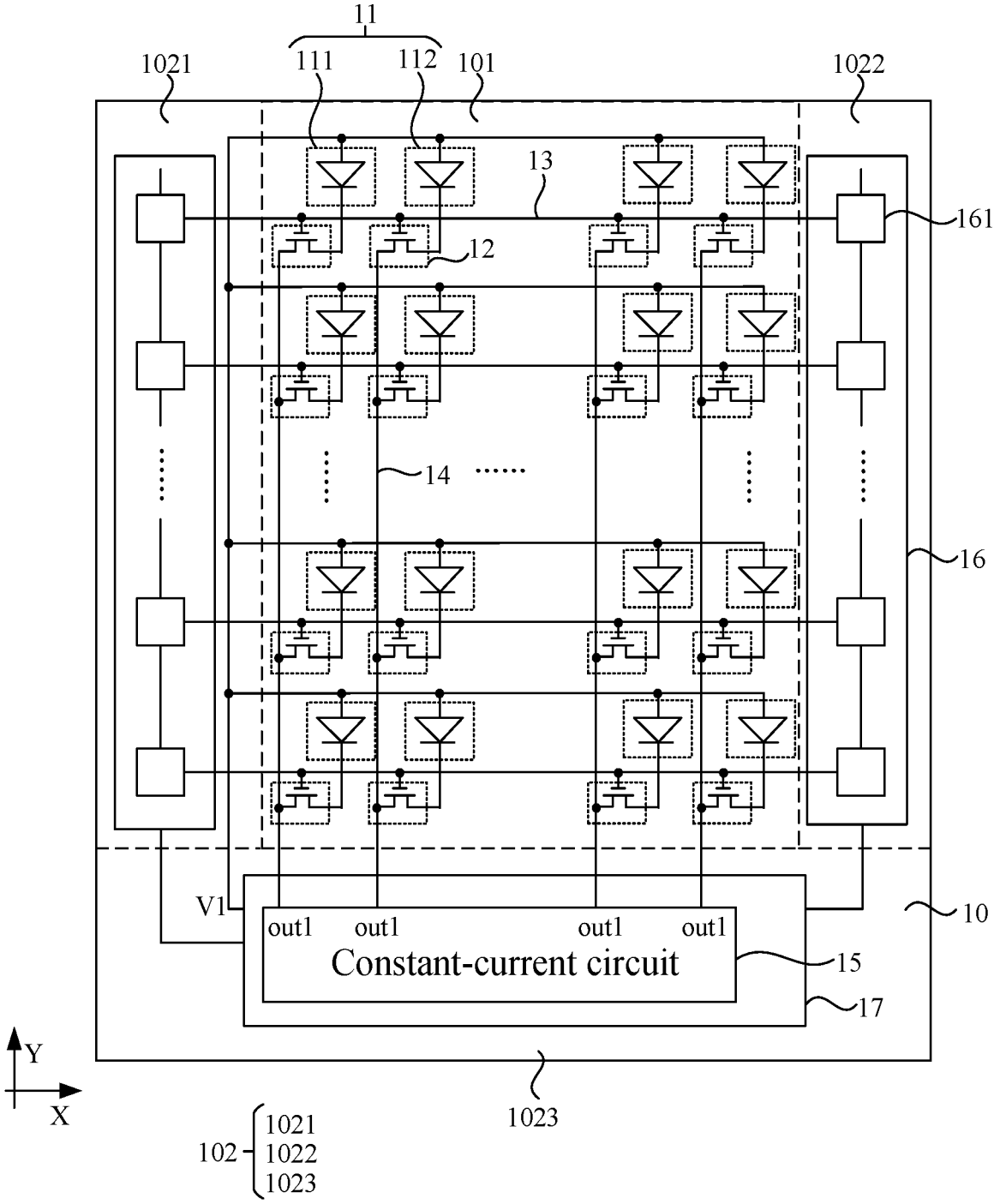
FIG. 2 is a diagram illustrating the structure of another light-emitting panel according to an embodiment of the present disclosure.

In an exemplary embodiment, FIG. 2 is a diagram illustrating the structure of another light-emitting panel according to an embodiment of the present disclosure. Referring to FIGS. 1-2, the light-emitting panel includes a display region 101 and a border region 102 surrounding the display region 101. At least one border of the border region 102 includes a shift register circuit 16. The shift register circuit 16 includes multiple cascaded shift registers 161. An output terminal of a shift register 161 is electrically connected to the scan signal line 13.

It is to be understood that FIG. 2 is only an exemplary diagram illustrating the relative position of the display region 101 and the border region 102. The border region 102 may surround part of the display region 101 or surround the periphery of the display region 101, which is not limited by the embodiment of the present disclosure.

With continued to FIG. 2, the output terminal of each stage of shift register 161 of the shift register circuit 16 is connected to a scan signal line 13 to provide a scan signal for the scan signal line 13 to control the turn-on or turn-off of the first switch units 12. Meanwhile, the output terminal of each stage of shift register circuit 161 is electrically connected to the input terminal of next stage of shift register 161. The input terminal of the first stage of shift register 161 receives a start pulse signal. The start pulse signal may be provided by a driver chip 17 which is electrically connected to a shift register circuit 16.

It is to be noted that the output terminal of each stage of shift register 161 may be electrically connected to more than one scan signal line 13. The output terminal of the same stage of shift register 161 may be electrically connected to multiple scan signal lines 13 that may be adjacent to each other or spaced apart from each other. FIG. 2 is only an exemplary illustration, and can be adjusted based on the actual needs.

In an exemplary embodiment, with continued to FIG. 2, the border region 102 includes a first border 1021, a second border 1022, and a third border 1023. The first border 1021 and the second border 1022 are arranged in the first direction X. The third border 1023 is located between the first border 1021 and the second border 1022. The first border 1021 and the second border 1022 are both adjacent to the third border 1023. The shift register circuit 16 is disposed in at least one of the first border 1021 or the second border 1022. The constant-current circuit 15 is disposed in the third border 1023.

It is to be understood that when a shift register circuit 16 is disposed in the first border 1021 and the second border 1022 separately, the shift register circuit 16 in the first border 1021 and the shift register circuit 16 in the second border 1022 may be connected to different scan signal lines 13 to provide scan signals for the scan signal lines 13 at different times. Exemplarily, the shift register circuit 16 in the first border 1021 is electrically connected to the scan signal lines 13 in the odd-numbered rows, and the shift register circuit 16 in the second border 1022 is electrically connected to the scan signal lines 13 in the even-numbered rows so that the circuit layout is more reasonable, mutual interference is avoided, and narrowing the border of the display panel is facilitated. Alternatively, the shift register circuit 16 in the first border 1021 and the shift register circuit 16 in the second border 1022 may be connected to the same scan signal line 13 (see FIG. 2) at the same time and provide scan signals for the same scan signal line 13, that is, the shift register circuit 16 in the first border 1021 and the shift register circuit 16 in the second border 1022 can simultaneously control the first switch units 12 electrically connected to the same scan signal line 13 to turn on so that the drive capability of the scan signal line 13 is improved, and the display quality of the light-emitting panel is improved. When the shift register circuit 16 is located at only one of the first border 1021 and the second border 1022, the circuit layout is simplified. Those skilled in the art may set the shift register circuit according to actual situations, and the embodiment of the present disclosure does not limited hereto. FIG. 2 is only an exemplary diagram illustrating that the first border 1021 and the second border 1022 are respectively provided with a shift register circuit 16.

In addition, the constant-current circuit 15 is provided in the third border 1023 so that the constant-current circuit 15 is prevented from being provided in the same border as the shift register circuit 16, which is beneficial to narrowing the border. Multiple output terminals of the constant-current circuit 15 are respectively electrically connected to the data signal lines 14. When the scanning signals respectively supplied from the scan signal lines 13 control the first switch units 12 to be turned on, the current output by the constant-current circuit 15 is supplied to the light-emitting units 11 through the data signal lines 14 and the first switch units 12, and drives the light-emitting units 11 to emit light under the action of the voltage supplied from the first supply voltage terminal V1.

In an exemplary embodiment, with continued to FIG. 2, the light-emitting panel further includes a driver chip 17 electrically connected to the shift register circuit 16, and the constant-current circuit 15 is integrated in the driver chip 17.

In an example, the driver chip 17 may be disposed in the third border 1023, and the constant-current circuit 15 is integrated in the driver chip 17 to simplify the circuit layout and facilitate narrowing the border of the light-emitting panel. In addition, the driver chip 17 may be electrically connected to the first supply voltage terminal V1 and supply voltage signal to the first supply voltage terminal V1, but is not limited thereto.

It should be noted that driver chip 17 may be bonded on the light-emitting panel. The bonding technique includes, but is not limited to, Chip on Glass (COG), Chip on FPC (COF), Tape Automated Bonding (TAB), or the like.

In an exemplary embodiment, with continued to FIG. 2, the first supply voltage terminal V1 includes a constant-voltage output terminal and the constant-current circuit 15 includes multiple first output terminals out1 for outputting adjustable currents.

In an example, when the first supply voltage terminal V1 is a constant-voltage output terminal, the voltage signal supplied to the light-emitting unit 11 is a constant voltage signal. The specific voltage value is not limited by the embodiment of the present disclosure, and may be supplied by a power module in the driver chip 17. At the same time, the output terminal of the constant-current circuit 15 includes multiple first output terminals out1 for outputting adjustable currents, that is, the constant-current circuit 15 may output current of any value. In this manner, based on the luminances required by the light-emitting units 11, the values of the currents output by the constant-current circuit 15 are different to drive the light-emitting units 11 to emit different luminances. At the same time, since the light-emitting panel does not need to provide an additional drive circuit, the power consumption of the light-emitting panel can be reduced.

Figure 3:
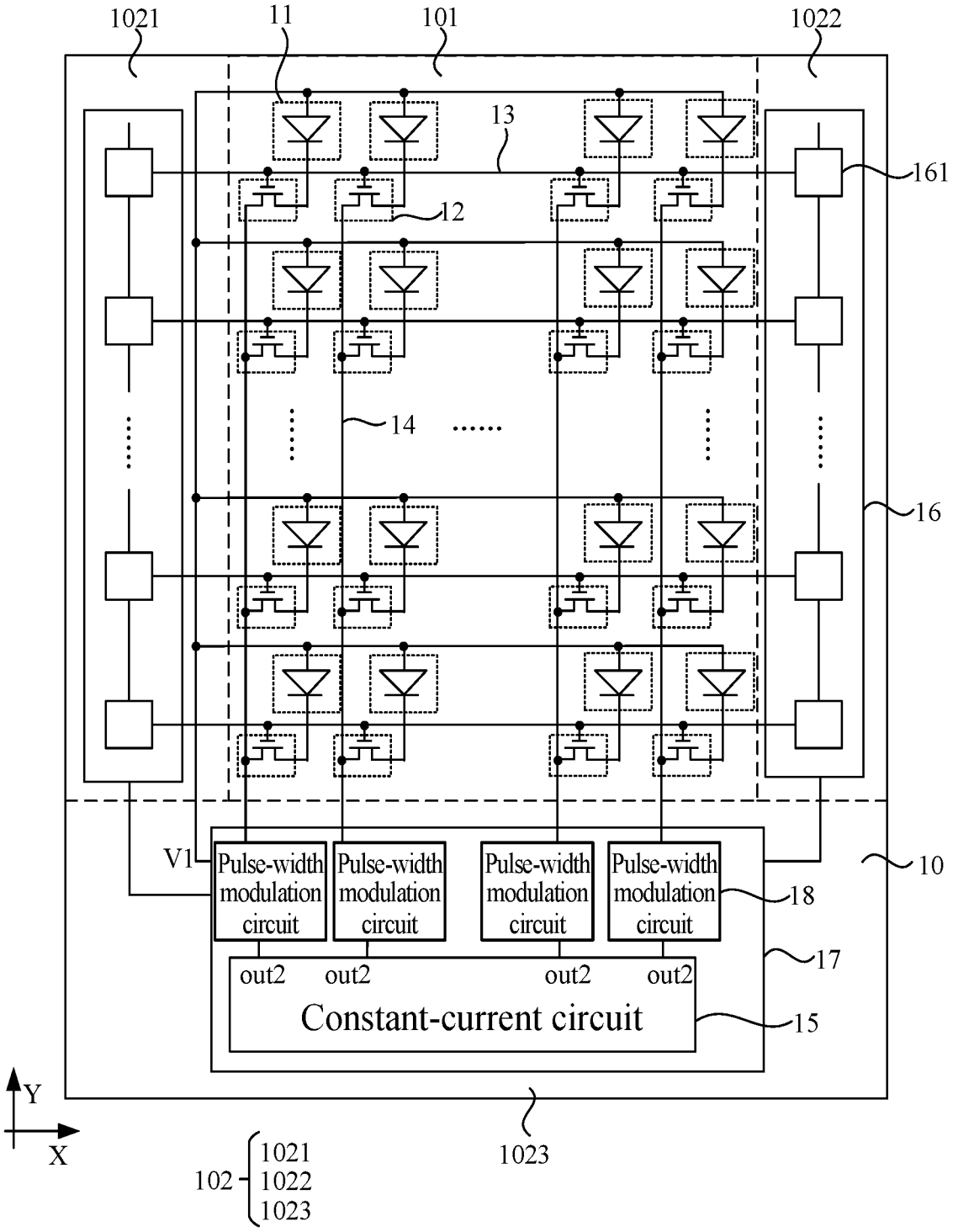
FIG. 3 is a diagram illustrating the structure of another light-emitting panel according to an embodiment of the present disclosure.

In another alternative embodiment, FIG. 3 is a diagram illustrating the structure of another light-emitting panel according to an embodiment of the present disclosure. As shown in FIG. 3, the first supply voltage terminal V1 includes a constant-voltage output terminal and the constant-current circuit 15 includes multiple output terminals out2 for outputting constant currents. The light-emitting panel further includes pulse-width modulation circuits 18 for adjusting the duty ratios of respective drive current signals output by the second output terminals out2.

In an example, the constant-current circuit 15 outputs a constant drive current signal through the second output terminals out2 and supplies the constant drive current signal to the pulse-width modulation circuits 18. Under the control of a pulse-width modulation circuit 18, the duty ratio of a respective drive current signal can be adjusted, that is, the value of the equivalent output current of the pulse-width modulation circuit 18 can be changed, and then the adjusted current signal is transmitted to the data signal line 14. In this manner, when the first switch unit 12 is turned on, the light-emitting unit 11 is enabled to light-emitting display under the action of the fixed voltage signal provided by the constant-voltage output terminal and the current signal output by the pulse-width modulation circuit 18 so that light-emitting display of different luminances can be enabled in the case of low power consumption of the light-emitting panel.

Figure 4:
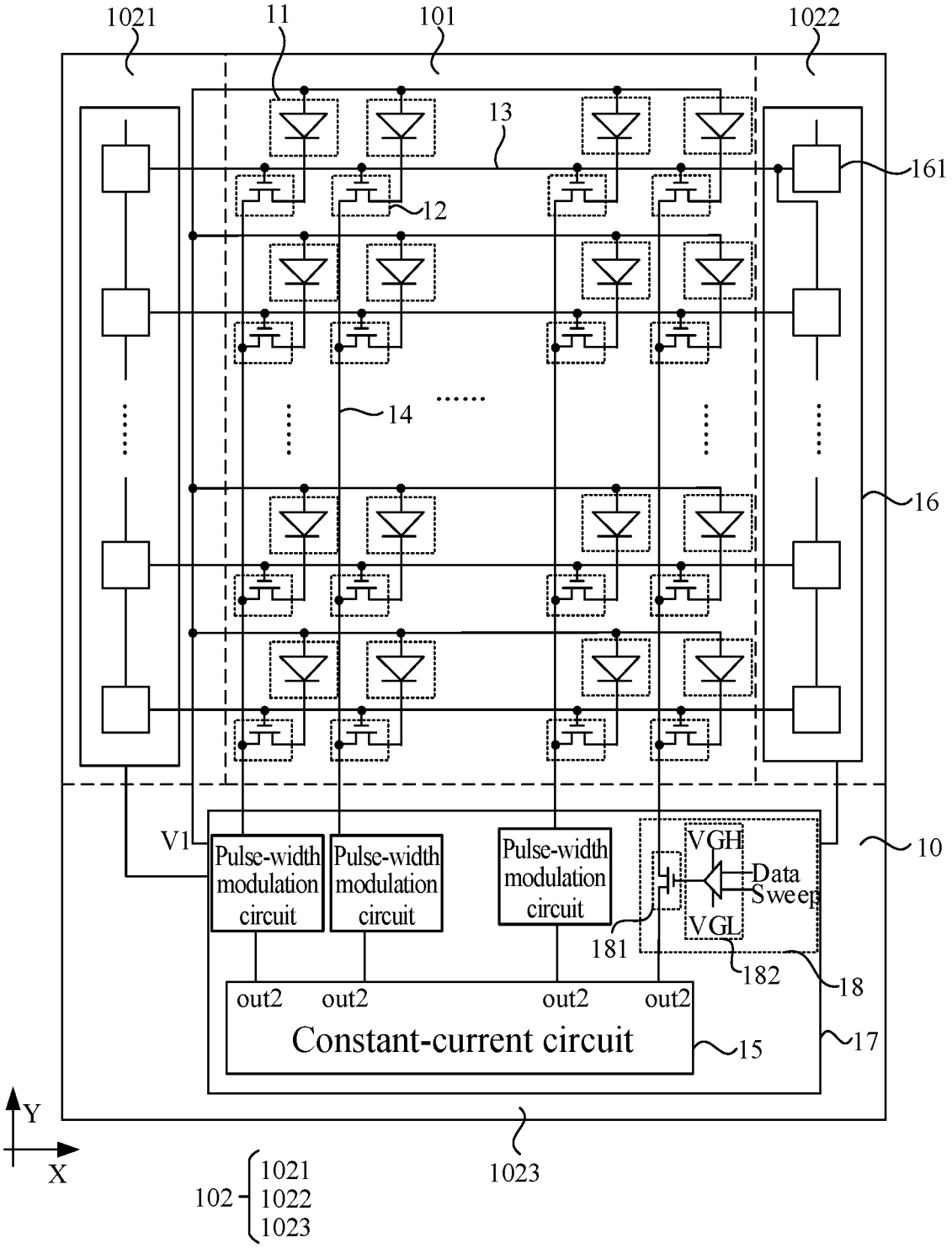
FIG. 4 is a diagram illustrating the structure of another light-emitting panel according to an embodiment of the present disclosure.

In an exemplary embodiment, FIG. 4 is a diagram illustrating the structure of another light-emitting panel according to an embodiment of the present disclosure. As shown in FIG. 4, the light-emitting unit 11 is electrically connected to the second output terminal out2 through the pulse-width modulation circuit 18. The pulse-width modulation circuit 18 includes a second switch unit 181 and a comparison circuit 182. The first terminal of the second switch unit 181 is electrically connected to the data signal line 14. The second terminal of the second switch unit 181 is electrically connected to the second output terminal out2. The control terminal of the second switch unit 181 is electrically connected to the output terminal of the comparison circuit 182. The first input terminal of the comparison circuit 182 is electrically connected to the data signal terminal Data. The second input terminal of the comparison circuit 182 is electrically connected to the swept-frequency signal terminal Sweep.

In an example, the second switch unit 181 may be switch transistor, and for example may be a P-type switch transistor or an N-type switch transistor, which is not limited by the embodiment of the present disclosure. The comparison circuit 182 compares the received data signal supplied from the data signal terminal DATA and the swept-frequency signal supplied from the swept-frequency signal terminal SWEEP, and outputs a switch control signal to control the turn-on or turn-off of the second switch unit 181 so that the second switch unit 181 adjusts the duty ratio of the drive current signal output by the second output terminal out2 under the control of the switch control signal output by the comparison circuit 182. In this manner, the luminance of the light-emitting unit 11 can be adjusted under the condition when the first switch unit 12 is on.

It is to be understood that the data signal of the data signal terminal DATA and the sweep signal of the sweep signal terminal SWEEP may be provided by the driver chip 17. The fixed level terminal VGH (i.e., high level) and VGL (i.e., low level) in the comparison circuit 182 may also be provided by driver chip 17.

It should be noted that the specific values of the data signal of the data signal terminal DATA and the sweep signal of the swept-frequency signal terminal SWEEP are not limited by the embodiment of the present disclosure. For example, the data signal, the constant voltage signal, and the swept-frequency signal may be carrier signals with an adjustable frequency.

In an exemplary embodiment, referring to FIG. 3 or FIG. 4, the pulse-width modulation circuit 18 and the constant-current circuit 15 are integrated in the same border of a border region of the light-emitting panel. In this embodiment, the same border refers to the border adjacent to one edge of the display region, such as the lower border or the left border. Exemplarily, the pulse-width modulation circuit 18 and the constant-current circuit 15 are integrated in the third border 1023 (the lower border) of the light-emitting panel and integrated in the driver chip 17 to simplify the circuit layout and facilitate narrowing the border of the light-emitting panel.

It is to be noted that, without special description, the following structure diagram given by the following embodiments will be described in terms of an example to illustrate exemplarily, that is, the output terminal of the constant-current circuit 15 includes multiple first output terminals out1 for outputting adjustable currents.

Figure 5:
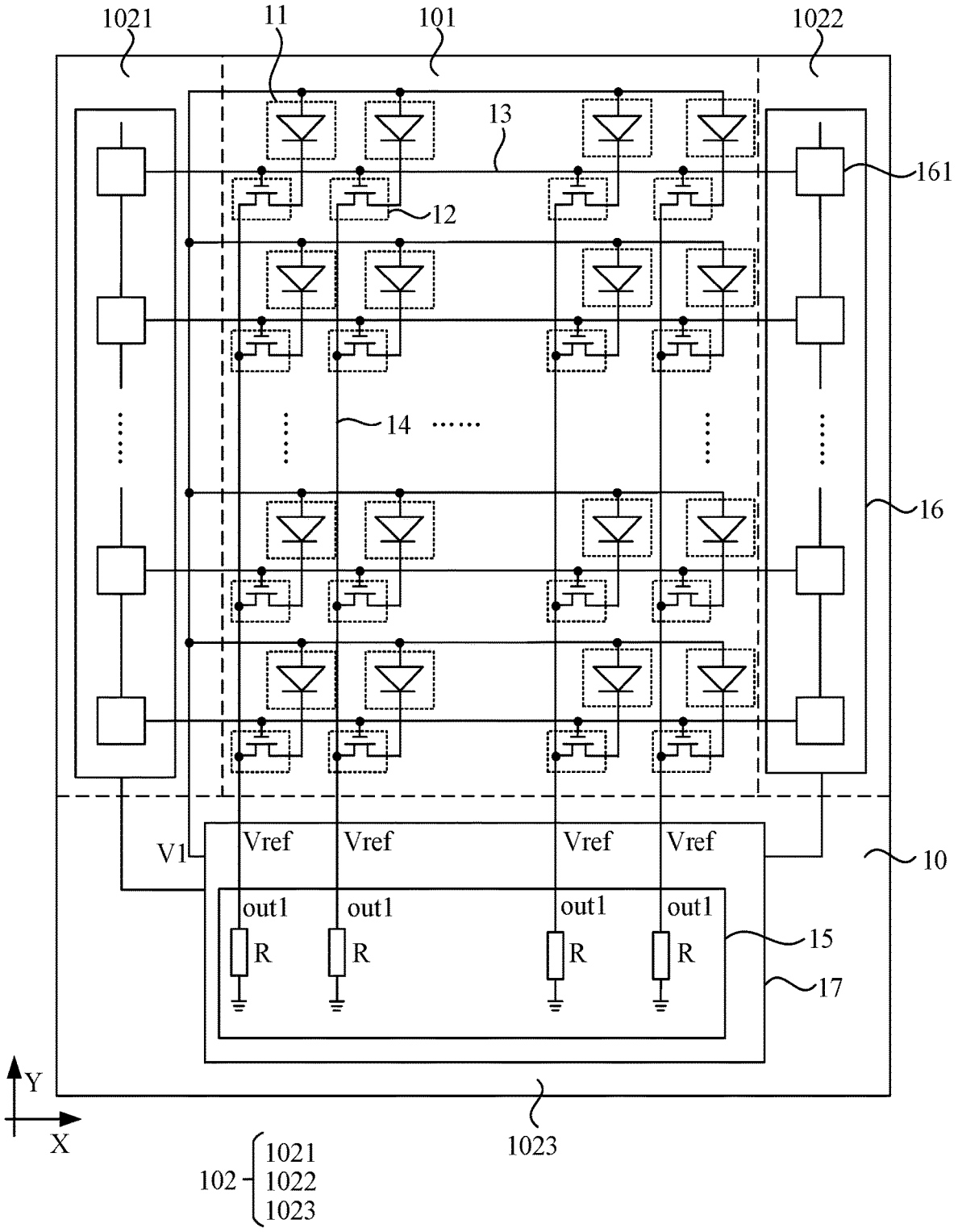
FIG. 5 is a diagram illustrating the structure of another light-emitting panel according to an embodiment of the present disclosure.

In an exemplary embodiment, FIG. 5 is a diagram illustrating the structure of another light-emitting panel according to an embodiment of the present disclosure. As shown in FIG. 5, the driver chip 17 includes multiple constant-voltage output terminals Vref electrically connected to the data signal line 14. The constant-current circuit 15 includes a variable resistor R, the first terminal of the variable resistor R is grounded, and the second terminal of the variable resistor R is electrically connected to the data signal line 14.

In an example, a constant-voltage output terminal Vref is used to provide a stable voltage signal vref for the second terminal of the variable resistor R. Because the first terminal of the variable resistor R is grounded, the current flowing through the variable resistor R in sequence is only related to the resistance value of the variable resistor R. That is, the larger the resistance value of the variable resistor R is, the smaller the current of the constant-current circuit 15 output through the first output terminal out1 is. On the contrary, the smaller the resistance value of the variable resistor R is, the larger the current of the constant-current circuit 15 output through the first output terminal out1 is. Thus, the current output by the first output terminal out1 can be adjusted by adjusting the resistance value of the variable resistor R. It is to be understood that if the output terminal of the constant-current circuit 15 is the second output terminal out2 outputting constant current, at this time, the resistance value of the variable resistor R can be kept constant so that the current output by the second output terminal out2 is constant.

In an exemplary embodiment, with continued to FIG. 5, when the light-emitting unit 11 is an organic light-emitting diode, the anode of the organic light-emitting diode is electrically connected to the first supply voltage terminal V1. At this time, to ensure that the current output by the output terminal of the constant-current circuit can be transmitted to the light-emitting unit 11 when the first switch unit 12 is turned on, the value of the stable voltage signal vref provided by the constant-voltage output terminal Vref should be less than the value of the voltage provided by the first supply voltage terminal V1.

Figure 6:
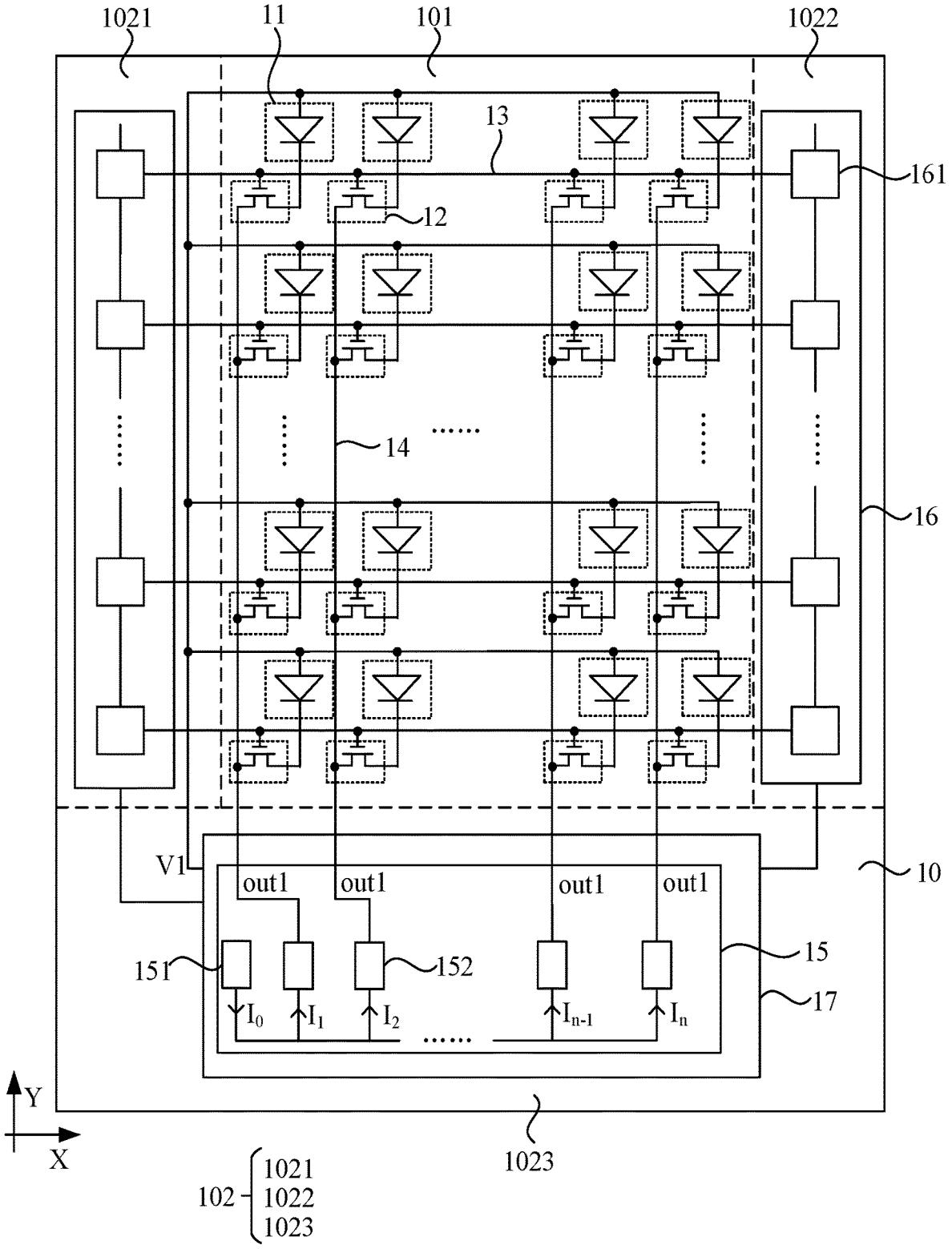
FIG. 6 is a diagram illustrating the structure of another light-emitting panel according to an embodiment of the present disclosure.

In an exemplary embodiment, FIG. 6 is a diagram illustrating the structure of another light-emitting panel according to an embodiment of the present disclosure. As shown in FIG. 6, the constant-current circuit 15 includes a current mirror circuit.

It is to be understood that the current mirror circuit is generally used to reproduce or replicate a reference current (i.e., mirror source current) of a branch in the circuit in other branches as the mirror current. There may be a proportional relationship between the mirror source current and the mirror current, and the proportion is only related to the channel size of the parameter of the transistor inside the current mirror circuit. In an example, the sum of all mirror currents may be made equal to the mirror source current. In this manner, a current mirror circuit enables a source current (i.e., mirror source current) to output multiple stable currents (i.e., mirror currents) at the same time, and then the multiple stable currents are transmitted to the data signal lines 14 by multiple output terminals of the constant-current circuit 15. The circuit structure is simple and easy to implement, the output current is stable and non-harmonic, thereby facilitating saving power consumption of the light-emitting panel.

In an exemplary embodiment, with continued to FIG. 6, the current mirror circuit includes a general branch circuit 151 and multiple constant-current branch circuits 152. The sum of the currents of multiple constant-current branch circuits 152 is equal to the current of the general branch circuit 151.

In an example, the current on the general branch circuit 151 is $I_0$, and the current on the constant-current branch circuit 152 is $I_i$, where n represents the total number of constant-current branch circuits 152, and the value of i is an integer greater than or equal to 1 and less than or equal to n. At this time, the current $I_0$ on the general branch circuit 151 and the current $I_i$ on the constant-current branch circuits 152 satisfy the formula $$I_0 = \sum_{i=1}^{n} I_i,$$

that is, the sum of current $I_i$ of multiple constant-current branch circuits 152 is equal to current $I_0$ on the general branch circuit 151. In this manner, only by changing the value of the current $I_0$ on the general branch circuit 151, the object of adjusting the current on multiple constant-current branch circuits 152 can be achieved, that is, to adjust the value of the current output by the output terminal of the constant-current circuit 15, thereby achieving the object of reducing power consumption of the light-emitting panel. Moreover, the circuit structure is simple, thereby facilitating the circuit layout and narrowing the border of the light-emitting panel.

Figure 7:
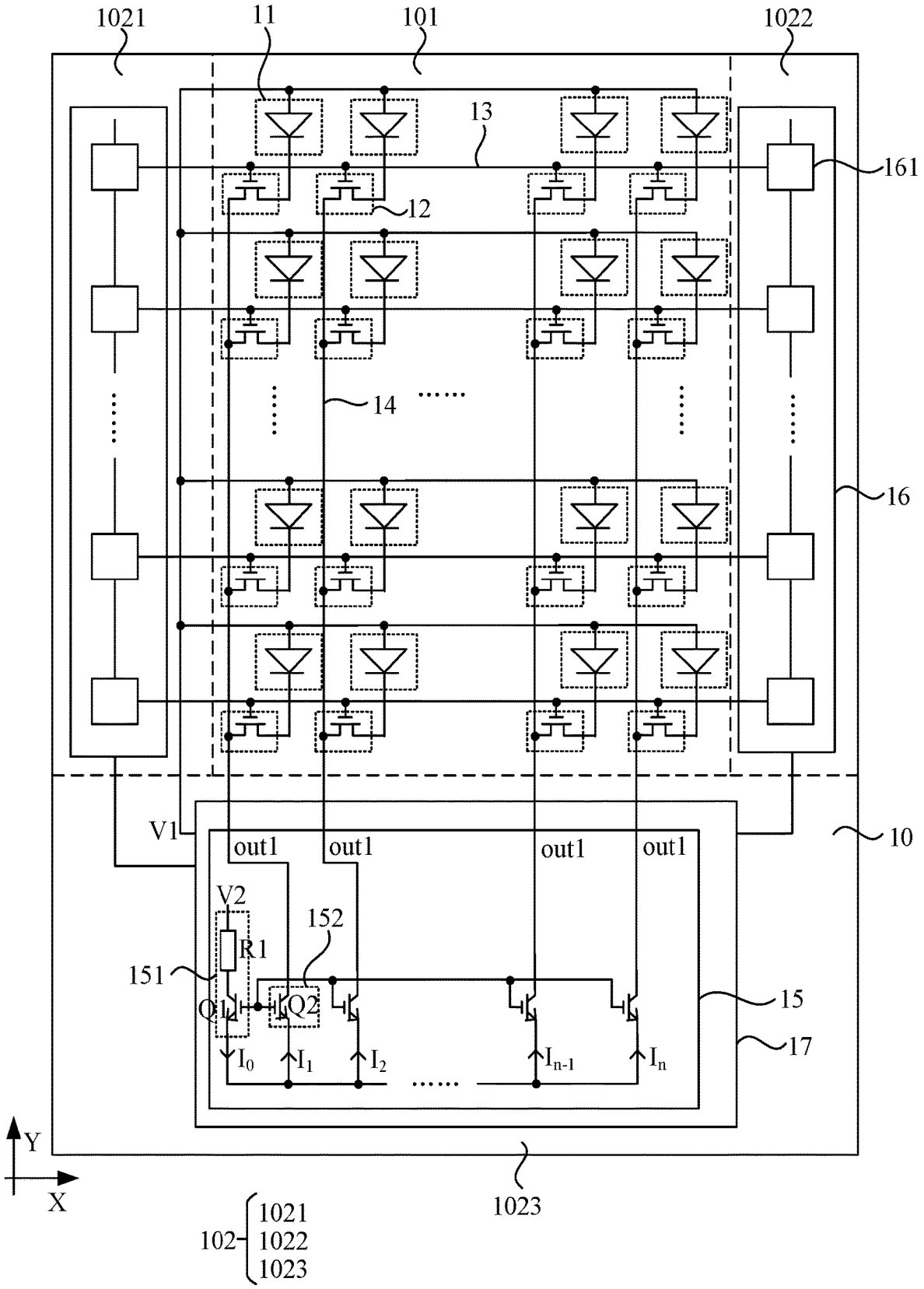
FIG. 7 is a diagram illustrating the structure of another light-emitting panel according to an embodiment of the present disclosure.

In an exemplary embodiment, FIG. 7 is a diagram illustrating the structure of another light-emitting panel according to an embodiment of the present disclosure. As shown in FIG. 7, the general branch circuit 151 includes a first resistor R1 and a first triode Q1. The constant-current branch circuit 152 includes a second triode Q2. The first terminal of the first resistor R1 is electrically connected to a second supply voltage terminal V2. The second terminal of the first resistor R1 is electrically connected to the collector electrode of the first triode Q1. The base electrode of the first triode Q1 is electrically connected to the base electrode of the second triode Q2. The emitter electrode of the first triode Q1 is electrically connected to and the emitter electrode of the second triode Q2.

In an example, under the action of the second supply voltage terminal V2, $I_0$ is generated by the first resistor R1, and the resistance value of the first resistor R1 is not limited by the embodiment, and can be set according to actual requirements. Then, according to the number of the constant-current branch circuits 152, the number of the second triodes Q2 may be different. All of the second triodes Q2 may be identical or different, which is not limited by the embodiment of the present disclosure. It is to be understood that when all of the second triodes Q2 are identical, the current corresponding to each constant-current branch circuit 152 may be identical, so that the light-emitting units 11 electrically connected to the scan signal line 13 in the same column receive the same current output by the constant-current circuit 15 when the first switch units 12 are turned on, and thus have the same luminance.

In another embodiment, since the luminance measured at the edge of the display region at the light-emitting panel is lower than the luminance at the center position, the current transmitted by the data signal line 14 near the edge of the display region 101 of the light-emitting panel may be made larger than the current transmitted by the data signal line 14 at the center position of the display region 101 to increase the evenness of the display of the light-emitting panel. Thus, by varying the channel sizes of the second transistors Q2 electrically connected to respective data signal lines 14, the current output by the constant-current circuit 15 to the data signal lines 14 near the edge of the display region 101 of the light-emitting panel is larger than the current output to the data signal line 14 at the center position of the display region 101.

It is to be understood that the sum of the currents of all the constant-current branch circuits 152 in the above-mentioned embodiments is constant, i.e., the constant $I_0$. Thus, the current $I_0$ on the general branch circuit 151 may be determined by varying the resistance value of the first resistor R1 or the voltage value supplied by the second supply voltage terminal V2. However, in practical applications, limited to the actual value of the second supply voltage terminal V2 and the resistance value of the first resistor R1, the maximum value of the current $I_0$ on the general branch circuit 152 is also relatively limited. When the number of constant-current branch circuits 152 is large and the light-emitting panel is required to provide a large luminance, it is difficult to ensure that the current output by the constant-current circuit 15 to each data signal line 14 is large enough.

Figure 8:
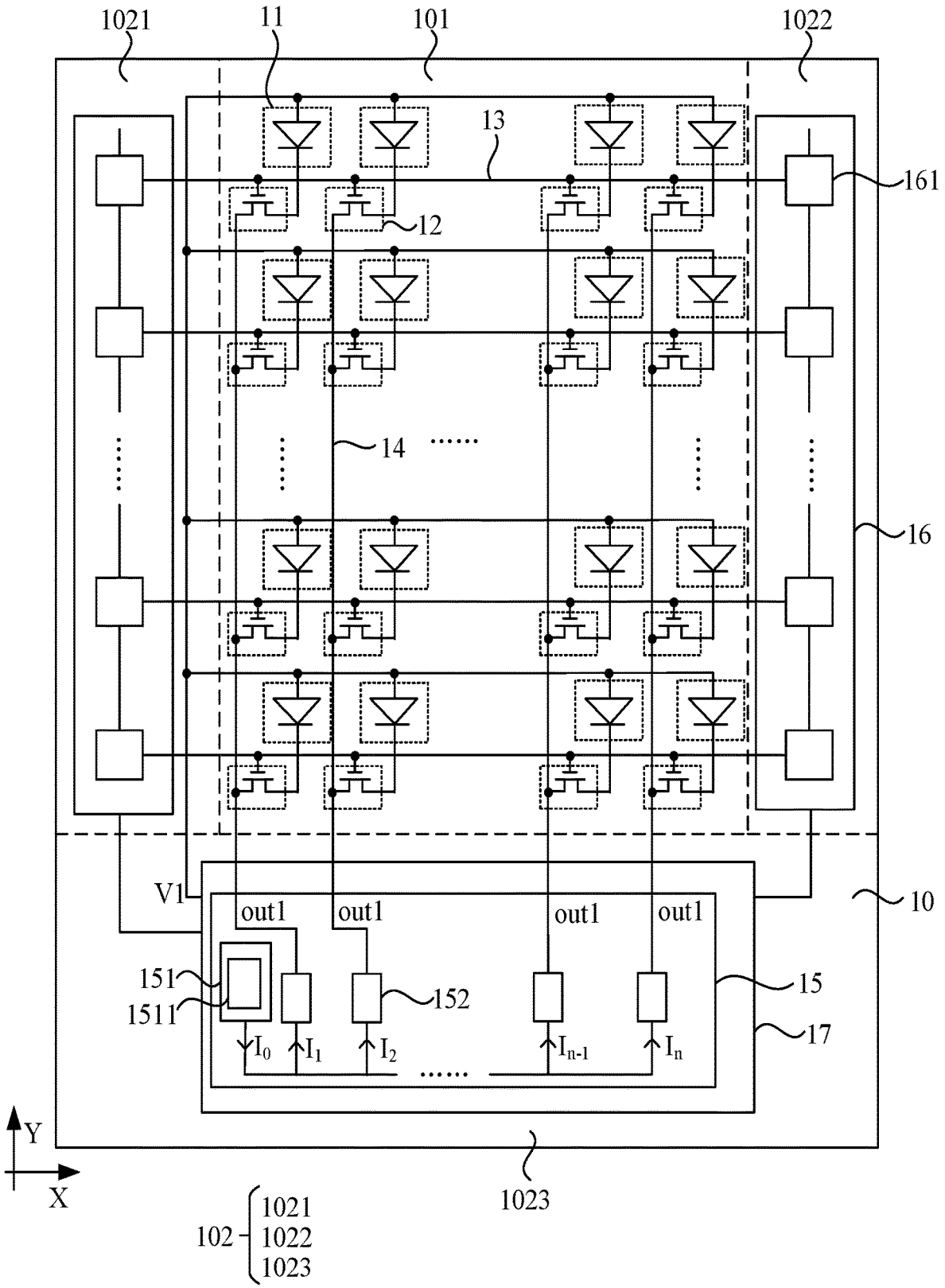
FIG. 8 is a diagram illustrating the structure of another light-emitting panel according to an embodiment of the present disclosure.

In an exemplary embodiment, FIG. 8 is a diagram illustrating the structure of another light-emitting panel according to an embodiment of the present disclosure. As shown in FIG. 8, the constant-current circuit 15 also includes an amplifier circuit 1511 connected to the general branch circuit 151.

In an example, the input terminal and output terminal of the amplifier circuit 1511 are connected to the general branch circuit 151. The energy source of the amplifier circuit may be provided by an external power. The current $I_0$ on the general branch circuit 151 may be amplified to the desired current value by the amplifier circuit 1511. The embodiment of the present disclosure set no limits on the specific circuit structure of the amplifier circuit 1511 and the amplification factor of the amplifier circuit 1511. The specifics may be set according to actual requirements. Exemplarily, the amplifier circuit 1511 may employ a conventional current amplifier.

Figure 9:
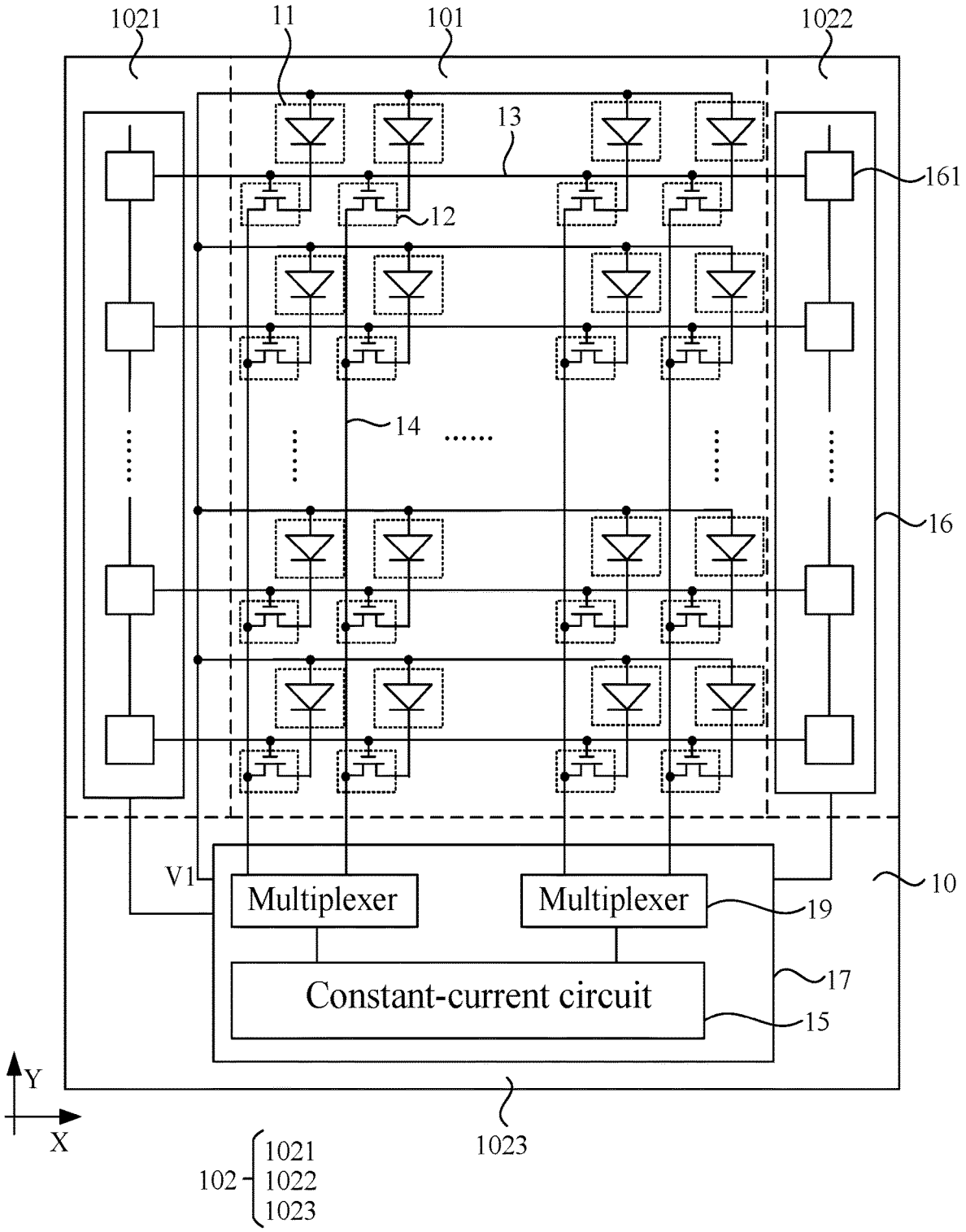
FIG. 9 is a diagram illustrating the structure of another light-emitting panel according to an embodiment of the present disclosure.

In an exemplary embodiment, FIG. 9 is a diagram illustrating the structure of another light-emitting panel according to an embodiment of the present disclosure. As shown in FIG. 9, the light-emitting panel also includes multiple multiplexers 19. The multiplexer 19 includes an input terminal and at least two output terminals. The input terminal of the multiplexer 19 is electrically connected to the output terminal of the constant-current circuit 15. The output terminal of the multiplexer 19 is electrically connected to the data signal line 14.

The specific number of multiplexer 19 and the number of output terminal of multiplexer 19 are not limited by the embodiment of the present disclosure, and may be designed according to actual requirements.

FIG. 9 only exemplarily illustrates that the multiplexer 19 includes two output terminals. Each output terminal is connected to a data signal line 14. In this manner, the constant-current circuit 15 may, when outputs currents through an output terminal, transmits currents to two data signal lines 14 after passing through the multiplexer 19 so that when the first switch unit 12 on the data signal line 14 is turned on, currents can be transmitted to the light-emitting unit 11 to drive the light-emitting unit 11 to perform light-emitting display. In this manner, without affecting the quality of the light-emitting display of the light-emitting panel light, it is ensured that the structure of the constant-current circuit 15 can be simplified so that the size of the border of the light-emitting panel can be reduced and narrowing the border of the light-emitting panel can be facilitated.

In an exemplary embodiment, with continued to FIG. 2, the light-emitting unit 11 includes the first light-emitting unit 111 and the second light-emitting unit 112. The drive current of the first light-emitting unit 111 is greater than the drive current of the second light-emitting unit 112. The first light-emitting unit 111 is located on a side of the second light-emitting unit 112 facing an edge of the light-emitting panel.

It is to be understood that when a light-emitting panel is used as a backlight, at the edge of the light-emitting panel, the edges of the fluorescent film layer and the quantum film layer disposed upon the light-emitting unit are ineffective, the edge luminance of the light-emitting panel is lower, that is, the luminance of the first light-emitting unit 111 is less than the luminance of the second light-emitting unit 112, resulting in uneven display of the light-emitting panel. In this regard, by setting that the drive current of the first light-emitting unit 111 being greater than the drive current of the second light-emitting unit 112, the luminance difference between the first light-emitting unit 111 and the second light-emitting unit 112 can be reduced, and the light-emitting display evenness of the light-emitting panel can be improved.

In an exemplary embodiment, with continued reference to FIGS. 1 to 9, the light-emitting unit 11 includes a light-emitting element. The embodiment of the present disclosure do not limit the color of the light emitted by the light-emitting element, such as red, green, blue, magenta, or other colors.

In another exemplary embodiment, the light-emitting unit 11 includes multiple light-emitting elements arranged in an array.

Figure 10:
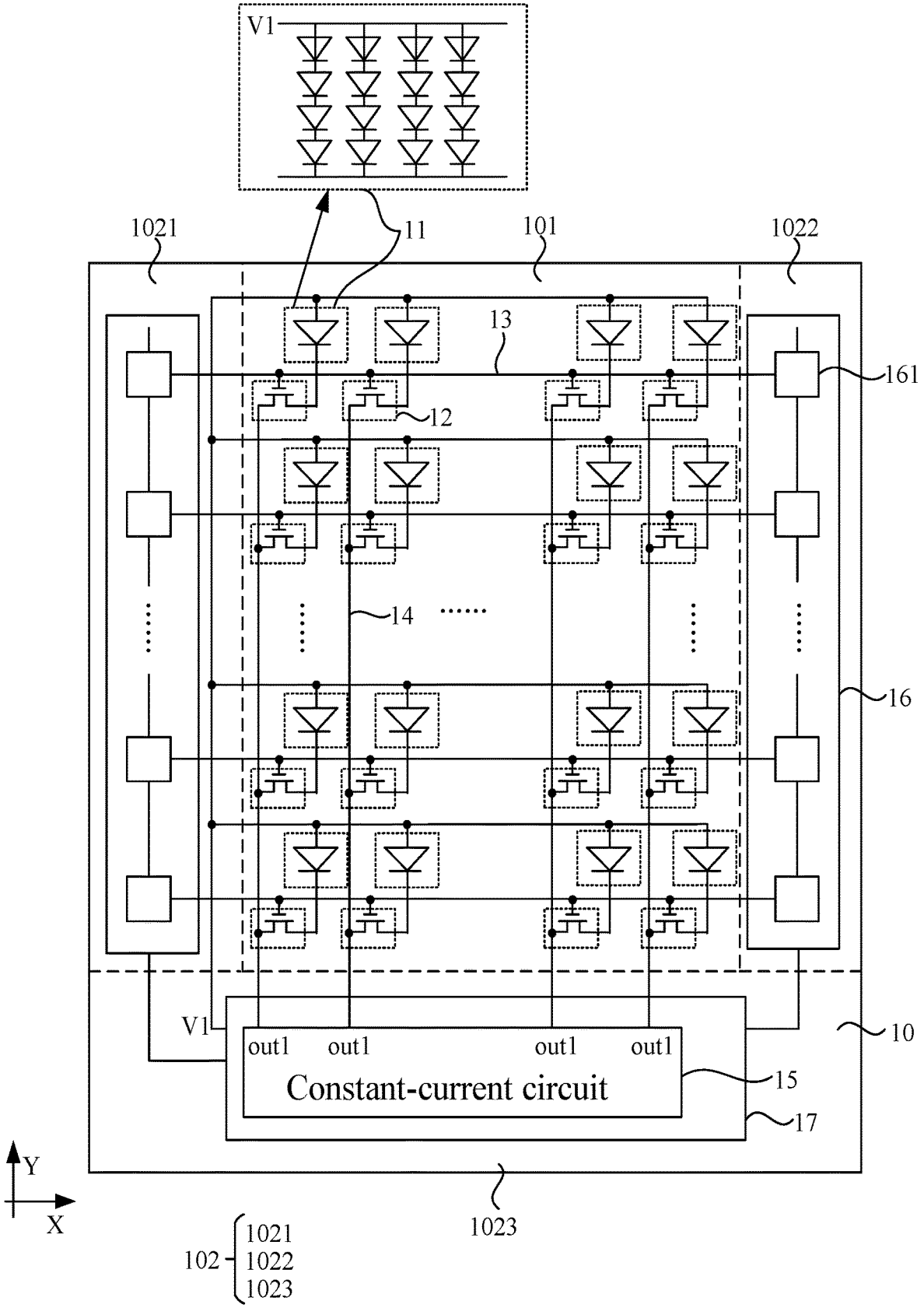
FIG. 10 is a diagram illustrating the structure of another light-emitting panel according to an embodiment of the present disclosure.

Exemplarily, FIG. 10 is a diagram illustrating the structure of another light-emitting panel according to an embodiment of the present disclosure. As shown in FIG. 10, FIG. 10 is an enlarged partial view of another light-emitting unit 11. The light-emitting units 11 may be composed of multiple light-emitting elements arranged in an array, i.e., the first terminals of light-emitting elements in the first row are connected to the first supply voltage terminal V1, and the second terminals of light-emitting elements in the last row are connected to the first terminal of the same first switch unit 12. In this manner, the light-emitting unit 11 is composed of light-emitting elements arranged in an array so that the display quality of the light-emitting panel can be improved, and the light-emitting panel can be ensured to have a lower power consumption.

It is to be noted that the specific arrangement and arrangement density of the light-emitting elements in the light-emitting unit 11 are not limited by the embodiment of the present disclosure and may be set according to actual requirements.

In an exemplary embodiment, in any of the above-described embodiments, the light-emitting element includes a submillimeter light-emitting diode or a micro light-emitting diode so that the light-emitting panel has advantages such as low power consumption, high luminance, ultra-high resolution and color saturation, fast reaction speed, super power saving, long service life, high efficiency, and the like.

Figure 11:
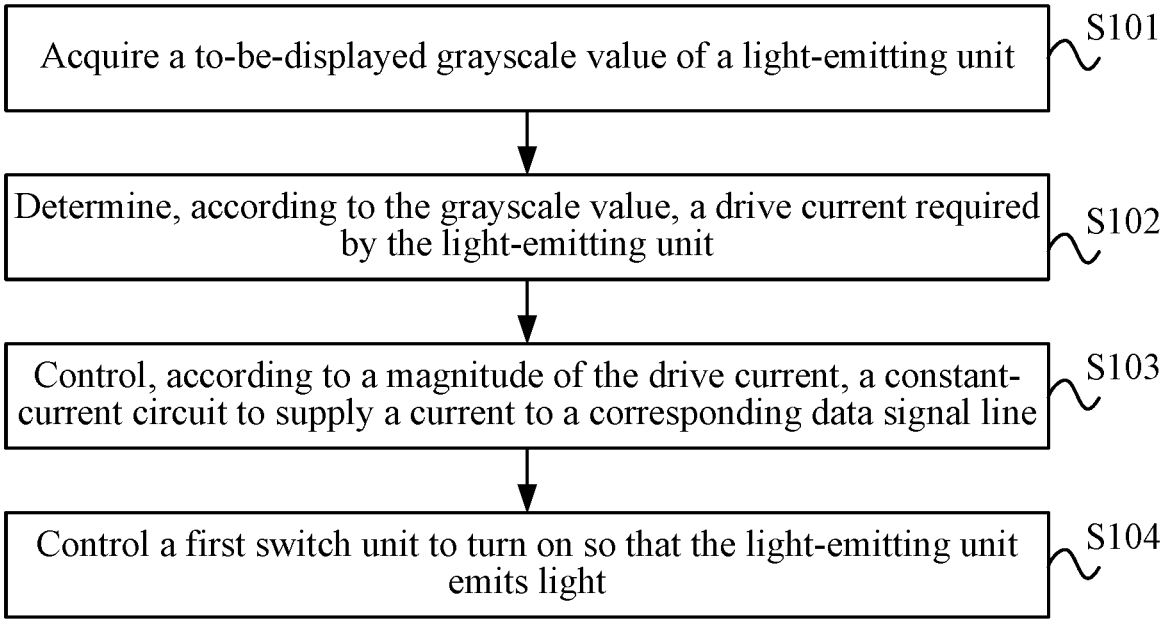
FIG. 11 is a flowchart of a driving method of a light-emitting panel according to an embodiment of the present disclosure.

Based on the same inventive concept, an embodiment of the present disclosure provides a driving method of a light-emitting panel, suitable for the light-emitting panel in any of the above-mentioned embodiments. FIG. 11 is a flowchart of the driving method of a light-emitting panel according to an embodiment of the present disclosure. As shown in FIG. 11, the driving method includes the steps below.

In S101, a to-be-displayed grayscale value of the light-emitting unit is acquired.

In S102, a drive current required by the light-emitting unit is determined according to the grayscale value.

In S103, a constant-current circuit is controlled according to the magnitude of the drive current to supply a current to a corresponding data signal line.

In S104, a first switch unit is controlled to turn on so that the light-emitting unit emits light.

As shown in FIG. 1, those skilled in the art can understand that when the light-emitting panel performs light emission, each light-emitting unit 11 corresponds to one grayscale value, which can be considered as the luminance of the light-emitting unit 11. The higher the grayscale value is, the higher the luminance of light-emitting unit 11 is, and when the scanning control signal provided by the scan signal line 13 controls the first switch unit 12 electrically connected to the light-emitting unit 11 to turn on, the larger the drive current output by the constant-current circuit 15 to the light-emitting unit 11 through the data signal line 14 is, the larger the integration of the human eyes on the luminance of light-emitting unit 11 emitting light so that the luminance exhibited by the light-emitting unit 11 is higher. The division of grayscale value levels is not limited by the embodiment of the present disclosure in any way, for example, the grayscale value may be divided into 256 (0-255) levels.

In an example, after obtaining the to-be-displayed grayscale value of the light-emitting unit, based on the correspondence between the grayscale value displayed by the light-emitting unit and the drive current required by the light-emitting unit, the drive current of the light-emitting unit can be obtained, in other words, the drive current of the light-emitting unit is the current that the constant-current circuit needs to provide to the corresponding data signal line for displaying the to-be-displayed grayscale value. Then the constant-current circuit is controlled to work to supply stable currents to the corresponding data signal lines. When the scanning signal provided by the scan signal line drives the first switch unit to be turned on, the drive current on the data signal line is transmitted to the light-emitting unit through the first switch unit to drive the light-emitting unit to emit light, thereby achieving the effect of saving power consumption.

In an exemplary embodiment, referring to FIG. 2, the constant-current circuit 15 includes multiple first output terminals out1 for outputting adjustable currents. The constant-current circuit 15 adjusts a magnitude of the constant current of the first output terminal to adjust a luminance of the light-emitting unit corresponding to the magnitude of the constant current. In this manner, adjustable drive current of any value can be output by the constant-current circuit 15 so that the light-emitting unit 11 can be driven to display luminance of any value. Then the power consumption is lower compared with the conventional driving method of using 7T1C or 2T1C pixel circuit to drive the light-emitting unit 11 to emit light, and the volume of the light-emitting panel is reduced.

In an exemplary embodiment, referring to FIG. 3 or FIG. 4, the constant-current circuit 15 includes multiple second output terminals out2 for outputting constant currents. The light-emitting panel also includes a pulse-width modulation circuit 18 that outputs a constant current signal having a different duty ratio to the second terminal of the light-emitting unit 11 to adjust the luminance of the light-emitting unit 11 corresponding to the constant current signal having the duty ratio. In this manner, the constant current output by the constant-current circuit 15 can be controlled by the pulse-width modulation circuit 18 to provide drive currents of different duty ratios to the data signal line 14 to drive the light-emitting unit 11 to adjust luminance to achieve the object of saving power consumption.

In an exemplary embodiment, along the direction from middle to two sides of the light-emitting panel, the currents output by the constant-current circuit to the data signal lines gradually increases.

It is to be understood that due to various factors such as preparation technique, the display luminance of the light-emitting panel of the edge region is generally lower than the display luminance of the intermediate region, resulting in unevenness of the display luminance, thereby affecting display effect.

Along the direction from middle to two sides of the light-emitting panel, the currents output by the constant-current circuit to the data signal lines gradually increases so that the luminance of the edge of the light-emitting panel can be gradually increased, and the display luminance at each position can smoothly transition, thereby avoiding the obvious light and dark boundary caused by abrupt luminance change, thereby improving the overall display evenness.

Based on the same inventive concept, an embodiment of the present disclosure also provides a display device including the light-emitting panel in any of the above-described embodiments. The display device includes the light-emitting panel according to any of embodiments of the present disclosure. Therefore, the display device according to the embodiment of the present disclosure includes the features of the light-emitting panel according to any of embodiments of the present disclosure, and can achieve the advantageous effect of the light-emitting panel according to any of embodiments of the present disclosure. Reference to the description of the light-emitting panel of embodiments of the present disclosure can be made when it comes to the same parts, and details are not described herein.

The light-emitting panel according to the embodiment of the present disclosure may be a display panel directly performing image display, or may be a backlight panel providing light for other display panel, which is not limited in the embodiment of the present disclosure.

Figure 12:
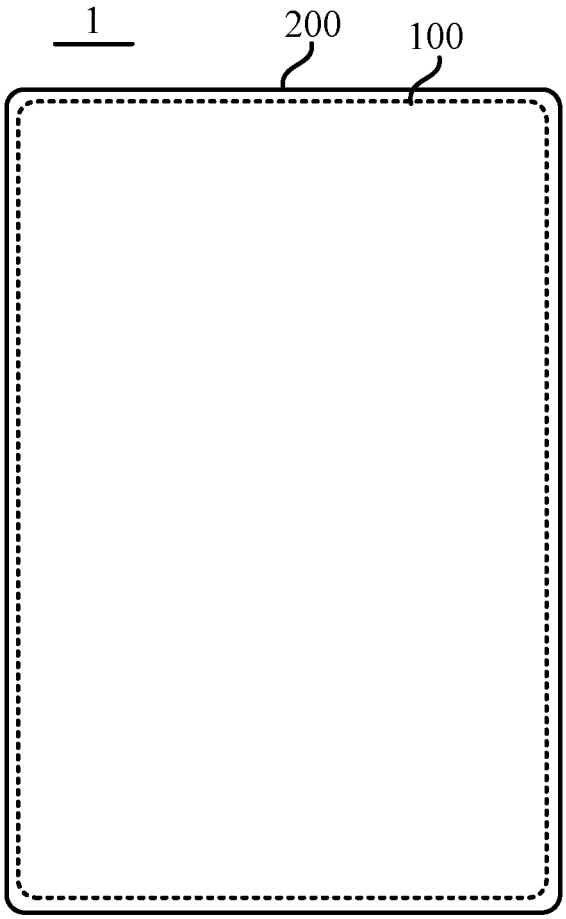
FIG. 12 is a diagram illustrating the structure of a display device according to an embodiment of the present disclosure.

In an alternative embodiment, FIG. 12 is a diagram illustrating the structure of a display device according to an embodiment of the present disclosure. As shown in FIG. 12, the display device 1 also includes a liquid-crystal display panel 200 located at the light-emitting side of the light-emitting panel 100, and the light-emitting panel 100 provides backlight for the liquid-crystal display panel 200. The display device 1 may be any electronic product having a display function, including but not limited to the following categories: television, laptop, desktop display, tablet computer, digital camera, mobile phone, smart bracelet, smart glasses, in-vehicle display, medical equipment, industrial control equipment, touch interactive terminal, and the like.

The above-mentioned specific embodiments do not constitute a limitation on the protection scope of the present disclosure. It is to be understood by those skilled in the art that various modifications, combinations, subcombinations, and substitutions may be made according to design requirements and other factors. Any modifications, equivalent replacements, improvements and the like within the spirit and principle of the present disclosure shall fall within the protection scope of the present disclosure.

What is claimed is:

1. A light-emitting panel, comprising:

a substrate;

a plurality of light-emitting units disposed on one side of the substrate and arranged in an array along a first direction and a second direction, wherein the first direction and the second direction intersect each other and are parallel to a plane where the substrate is located;

a plurality of first switch units, wherein a first terminal of a light-emitting unit of the plurality of light-emitting units is electrically connected to a first supply voltage terminal, a second terminal of the light-emitting unit is electrically connected to a first terminal of a respective first switch unit of the plurality of first switch units, a control terminal of the first switch unit is electrically connected to a scan signal line extending along the first direction, and a second terminal of the first switch unit is electrically connected to a data signal line extending along the second direction; and a constant-current circuit, wherein an output terminal of the constant-current circuit is electrically connected to the data signal line;

wherein the constant-current circuit comprises a current mirror circuit, the current mirror circuit comprises a general branch circuit and a plurality of constant-current branch circuits;

wherein the general branch circuit comprises a first resistor and a first triode, and a constant-current branch circuit of the plurality of constant-current branch circuits comprises a second triode, wherein a first terminal of the first resistor is electrically connected to a second supply voltage terminal, a second terminal of the first resistor is electrically connected to a collector electrode of the first triode, a base electrode of the first triode is electrically connected to a base electrode of the second triode, and an emitter electrode of the first triode is electrically connected to an emitter electrode of the second triode.

2. The light-emitting panel according to claim 1, wherein the first supply voltage terminal comprises a constant-voltage output terminal, and the constant-current circuit comprises a plurality of first output terminals for outputting adjustable currents.

3. The light-emitting panel according to claim 1, wherein the first supply voltage terminal comprises a constant-voltage output terminal, and the constant-current circuit comprises a plurality of second output terminals for outputting constant currents; and the light-emitting panel further comprises a pulse-width modulation circuit for adjusting a duty ratio of a drive current signal output by a respective second output terminal of the plurality of second output terminals.

4. The light-emitting panel according to claim 3, wherein the light-emitting unit is electrically connected to the second output terminal through the pulse-width modulation circuit;

the pulse-width modulation circuit comprises a second switch unit and a comparison circuit, wherein a first terminal of the second switch unit is electrically connected to the data signal line, a second terminal of the second switch unit is electrically connected to the second output terminal, and a control terminal of the second switch unit is electrically connected to an output terminal of the comparison circuit, and a first input terminal of the comparison circuit is electrically connected to a data signal terminal, and a second input terminal of the comparison circuit is electrically connected to a swept-frequency signal terminal.

5. The light-emitting panel according to claim 3, wherein the pulse-width modulation circuit and the constant-current circuit are integrated in a same border of a border region of the light-emitting panel.

6. The light-emitting panel according to claim 1, wherein the light-emitting panel comprises a display region and a border region surrounding the display region, at least one border of the border region comprises a shift register circuit, the shift register circuit comprises a plurality of cascaded shift registers, and an output terminal of a shift register of the plurality of shift registers is electrically connected to the scan signal line.

7. The light-emitting panel according to claim 6, wherein the border region comprises a first border, a second border, and a third border, wherein the first border and the second border are arranged in the first direction, the third border is located between the first border and the second border, and the first border and the second border are both adjacent to the third border; and the shift register circuit is disposed in at least one of the first border or the second border, and the constant-current circuit is disposed in the third border.

8. The light-emitting panel according to claim 6, further comprising a driver chip electrically connected to the shift register circuit, wherein the constant-current circuit is integrated in the driver chip.

9. The light-emitting panel according to claim 8, wherein the driver chip comprises a plurality of constant-voltage output terminals, wherein a constant-voltage output terminal of the plurality of constant-voltage output terminals is electrically connected to the data signal line; and the constant-current circuit comprises a variable resistor, a first terminal of the variable resistor is grounded, and a second terminal of the variable resistor is electrically connected to the data signal line.

10. The light-emitting panel according to claim 1, wherein a sum of currents of the plurality of constant-current branch circuits is equal to a current of the general branch circuit.

11. The light-emitting panel according to claim 10, further comprising an amplifier circuit connected to the general branch circuit.

12. The light-emitting panel according to claim 1, further comprising a plurality of multiplexers, wherein a multiplexer of the plurality of multiplexers comprises an input terminal and at least two output terminals, the input terminal of the multiplexer is electrically connected to the output terminal of the constant-current circuit, and an output terminal of the at least two output terminals of the multiplexer is electrically connected to the data signal line.

13. The light-emitting panel according to claim 1, wherein the light-emitting unit comprises a first light-emitting unit and a second light-emitting unit, wherein a drive current of the first light-emitting unit is greater than a drive current of the second light-emitting unit, and the first light-emitting unit is located on a side of the second light-emitting unit facing an edge of the light-emitting panel.

14. The light-emitting panel according to claim 1, wherein the light-emitting unit comprises one light-emitting element or a plurality of light-emitting elements arranged in an array.

15. A driving method of a light-emitting panel, the driving method being applied to a light-emitting panel, wherein the light-emitting panel comprises: a substrate; a plurality of light-emitting units disposed on one side of the substrate and arranged in an array along a first direction and a second direction, wherein the first direction and the second direction intersect each other and are parallel to a plane where the substrate is located; a plurality of first switch units, wherein a first terminal of a light-emitting unit of the plurality of light-emitting units is electrically connected to a first supply voltage terminal, a second terminal of the light-emitting unit is electrically connected to a first terminal of a respective first switch unit of the plurality of first switch units, a control terminal of the first switch unit is electrically connected to a scan signal line extending along the first direction, and a second terminal of the first switch unit is electrically connected to a data signal line extending along the second direction; and a constant-current circuit, wherein an output terminal of the constant-current circuit is electrically connected to the data signal line; wherein the constant-current circuit comprises a current mirror circuit, the current mirror circuit comprises a general branch circuit and a plurality of constant-current branch circuits; wherein the general branch circuit comprises a first resistor and a first triode, and a constant-current branch circuit of the plurality of constant-current branch circuits comprises a second triode, wherein a first terminal of the first resistor is electrically connected to a second supply voltage terminal, a second terminal of the first resistor is electrically connected to a collector electrode of the first triode, a base electrode of the first triode is electrically connected to a base electrode of the second triode, and an emitter electrode of the first triode is electrically connected to an emitter electrode of the second triode; wherein the driving method comprises:

acquiring a to-be-displayed grayscale value of the light-emitting unit;

determining, according to the grayscale value, a drive current required by the light-emitting unit;

controlling, according to a magnitude of the drive current, the constant-current circuit to supply a current to a corresponding data signal line; and controlling the first switch unit to turn on so that the light-emitting unit emits light.

16. The driving method according to claim 15, wherein the constant-current circuit comprises a plurality of first output terminals for outputting adjustable currents, and the constant-current circuit is configured to adjust a magnitude of a constant current of a first output terminal of the plurality of first output terminals to adjust a luminance of the light-emitting unit electrically connected to the first output terminal.

17. The driving method according to claim 15, wherein the constant-current circuit comprises a plurality of second output terminals for outputting constant currents, and the light-emitting panel further comprises a pulse-width modulation circuit, wherein the pulse-width modulation circuit is configured to output a constant current signal having a different duty ratio to a second terminal of the light-emitting unit to adjust a luminance of the light-emitting unit corresponding to the constant current signal having the duty ratio.

18. A display device, comprising a light-emitting panel, wherein the light-emitting panel comprises:

a substrate;

a plurality of light-emitting units disposed on one side of the substrate and arranged in an array along a first direction and a second direction, wherein the first direction and the second direction intersect each other and are parallel to a plane where the substrate is located;

a plurality of first switch units, wherein a first terminal of a light-emitting unit of the plurality of light-emitting units is electrically connected to a first supply voltage terminal, a second terminal of the light-emitting unit is electrically connected to a first terminal of a respective first switch unit of the plurality of first switch units, a control terminal of the first switch unit is electrically connected to a scan signal line extending along the first direction, and a second terminal of the first switch unit is electrically connected to a data signal line extending along the second direction; and a constant-current circuit, wherein an output terminal of the constant-current circuit is electrically connected to the data signal line;

wherein the constant-current circuit comprises a current mirror circuit, the current mirror circuit comprises a general branch circuit and a plurality of constant-current branch circuits;

wherein the general branch circuit comprises a first resistor and a first triode, and a constant-current branch circuit of the plurality of constant-current branch circuits comprises a second triode, wherein a first terminal of the first resistor is electrically connected to a second supply voltage terminal, a second terminal of the first resistor is electrically connected to a collector electrode of the first triode, a base electrode of the first triode is electrically connected to a base electrode of the second triode, and an emitter electrode of the first triode is electrically connected to an emitter electrode of the second triode.

19. The display device according to claim 18, wherein the first supply voltage terminal comprises a constant-voltage output terminal, and the constant-current circuit comprises a plurality of first output terminals for outputting adjustable currents.

20. The display device according to claim 18, wherein the light-emitting panel comprises a display region and a border region surrounding the display region, at least one border of the border region comprises a shift register circuit, the shift register circuit comprises a plurality of cascaded shift registers, and an output terminal of a shift register of the plurality of shift registers is electrically connected to the scan signal line.

* * * * *